US008607477B2

(12) United States Patent
Åmark

(10) Patent No.: US 8,607,477 B2
(45) Date of Patent: Dec. 17, 2013

(54) SPIKE DEVICE FOR AN ANTI-SLID SHOE

(75) Inventor: Mikael Åmark, Brottby (SE)

(73) Assignee: Grip Force Technologies AB, Vastra Frolunda (SE)

( * ) Notice: Subject to any disclaimer, the term of this patent is extended or adjusted under 35 U.S.C. 154(b) by 386 days.

(21) Appl. No.: 12/920,935

(22) PCT Filed: Mar. 7, 2008

(86) PCT No.: PCT/SE2008/000187
§ 371 (c)(1),
(2), (4) Date: Nov. 17, 2010

(87) PCT Pub. No.: WO2009/110822
PCT Pub. Date: Sep. 11, 2009

(65) Prior Publication Data

US 2011/0126426 A1 Jun. 2, 2011

(51) Int. Cl.
*A43C 15/02* (2006.01)
*A43C 15/14* (2006.01)

(52) U.S. Cl.
USPC ..... 36/61; 34/134

(58) Field of Classification Search
USPC ..... 36/61, 62, 134, 59 R, 67 D, 67 R, 67 A, 36/59 A, 59 C
See application file for complete search history.

(56) References Cited

U.S. PATENT DOCUMENTS 4,375,729 A 3/1983 Buchanen, III
4,825,562 A 5/1989 Chuang
4,873,774 A 10/1989 Lafever
5,299,369 A 4/1994 Goldman
5,337,494 A 8/1994 Ricker
5,526,589 A * 6/1996 Jordan ..... 36/134
5,732,482 A * 3/1998 Remington et al. ..... 36/61
5,815,951 A * 10/1998 Jordan ..... 36/61

(Continued)

FOREIGN PATENT DOCUMENTS

AT 411812 B 6/2004
DE 3924360 A1 1/1991

(Continued)

OTHER PUBLICATIONS

International Search Report, mailed Oct. 15, 2008, of corresponding international Application No. PCT/SE2008/000187, filed Mar. 7, 2008.

(Continued)

*Primary Examiner* — Jila M Mohandesi
(74) *Attorney, Agent, or Firm* — Alston & Bird LLP

(57) ABSTRACT

Various embodiments provide a spike device for a sole of an anti-slid shoe. The device comprises at least a spike and a resilient member comprising an elastic diaphragm hving an inner portion and an outer portion. A spike unit comprising the spike is arranged in an opening in the inner portion of the elastic diaphragm such that the spike protrudes in an axial direction from the elastic diaphragm. The spike unit is movable in an axial direction and fixed in relation to the opening so as to allow the spike unit to move together with the inner portion of the elastic diaphragm. The spike device further comprises a guiding and supporting means for guiding the axial movement of the spike unit when the inner poriton moves in relation to the outer portion. A shoe comprising the spike device is also provided, having respective lower and upper sole members.

15 Claims, 7 Drawing Sheets

(56) References Cited

U.S. PATENT DOCUMENTS

| | | | | |
|---|---|---|---|---|
| 6,058,627 | A | 5/2000 | Violette et al. | |
| 6,079,127 | A * | 6/2000 | Nishimura et al. | 36/61 |
| 6,125,556 | A | 10/2000 | Peckler et al. | |
| 7,234,250 | B2 * | 6/2007 | Fogarty et al. | 36/61 |
| 7,490,418 | B2 * | 2/2009 | Obeydani | 36/61 |

FOREIGN PATENT DOCUMENTS

| | | | |
|---|---|---|---|
| GB | 2420485 | | 5/2006 |
| JP | 50-17134 | | 12/1973 |
| JP | 8-256801 | A | 10/1996 |
| JP | 3106804 | U | 1/2005 |
| JP | 2012-231999 | A | 11/2012 |
| SE | 524692 | | 9/2004 |
| WO | WO 2007/037731 | A1 | 4/2007 |

OTHER PUBLICATIONS

European Patent Office, Extended European Search Report for Application No. 08724119.6, Apr. 5, 2013, 4 pages, Germany.

* cited by examiner

SPIKE DEVICE FOR AN ANTI-SLID SHOE

CROSS REFERENCE TO RELATED APPLICATIONS

This application is a national stage application, filed under 35 U.S.C. §371, of International Application No. PCT/SE2008/000187, filed Mar. 7, 2008, which is hereby incorporated by reference in its entirety.

BACKGROUND OF THE INVENTION

1. Field of Invention

This invention relates to a spike device for a sole of an anti-slid shoe. The invention also relates to a shoe comprising such a spike device.

2. Description of Related Art

Shoes equipped with spikes are used for getting a good grip on slippery surfaces. Typically, spiked shoes are useful for people walking on streets or pavements covered with snow and ice and for golfers. Conventional spiked shoes suffer from the drawback that the spikes are in constant contact with ground surface during wear, also in situations where spikes are not necessary, such as on hard surfaces, or where spikes are unsuitable, such as on most indoor floors. This causes excessive wear on the spikes and certain surfaces or makes a frequent switching of shoes necessary.

To overcome these disadvantages various examples of shoes with retractable spikes has been proposed over the years. U.S. Pat. No. 4,873,774 discloses one example where a fluid pressure is used to push cleats to extend from the sole bottom. Another example is disclosed in U.S. Pat. No. 5,299,369 where pneumatically actuated, rotatable spikes are used. Still another example is disclosed in U.S. Pat. No. 6,058,627 where spikes are slidable between a retracted and an extended position. Still another example is disclosed in U.S. Pat. No. 6,125,556 where high pressure liquid is used to extend the spikes.

SE 524692 discloses a system where hydraulically actuated and controlled lifting pads placed under the outer sole are arranged to expand such that spikes mounted to the outer sole loose contact with the ground.

U.S. Pat. No. 4,375,729 discloses a footwear having spikes attached to flexible recesses or dimples of the sole, wherein a sliding cam member is used to urge the spikes from a retracted to an extended position.

WO 2007/037731 discloses a structure where an upper and lower sole are movable in relation to each other and where a slidable locking plate is used to lock the soles in relation to each other. Springs are used for forcing the soles apart such as to retract the spikes. GB 2420485 discloses a similar structure, but without locking function, where partly retracted spring-suspended sole nails are forced to protrude by applying a pressure onto the upper sole.

General problems associated with the known shoes with retractable spikes are a complex structure, a low structural strength and/or functioning problems when exposed to dirt. Thus improvements are still needed in this field.

BRIEF SUMMARY OF THE INVENTION

An object of this invention is to provide an anti-slid shoe with retractable spikes and that is less complex and more reliable than what is previously known.

This object is achieved by the spike device and the shoe defined by the technical features contained in independent claims 1, and 12. The dependent claims contain advantageous embodiments, further developments and variants of the invention.

The invention concerns a spike device for a sole of an anti-slid shoe, comprising a spike and a resilient means, said resilient means being arranged to, when in a stressed state, allow the spike to protrude from the sole of the shoe for providing anti-slid properties and to, when reverting to an unstressed state, retract the spike at least partly into the sole.

The inventive spike device is characterized in that the resilient means comprises an elastic diaphragm means having an inner portion and an outer portion surrounding the inner portion, wherein the inner and outer portions are resiliently movable in relation to each other. Further, a spike unit comprising the spike is arranged in an opening in the inner portion of the diaphragm means in such a way that the spike protrudes in an axial direction from the diaphragm means, wherein the spike unit is arranged to be moveable in an axial direction and to be fixed in relation to the opening such as to allow the spike unit to move together with the inner portion of the diaphragm means. The spike device further comprises a guiding and supporting means for guiding the axial movement of the spike unit when the inner portion moves in relation to the outer portion.

An advantage of such a design is that the use of conventional coil springs for the automatic retraction of the spikes can be avoided. Incorporating such coil springs into the shoe makes, the production complicated. Moreover, the function of coil springs is likely to be inhibited due to dust, dirt and corrosion.

Another advantage is that a proper sealing around the spike is much easier to achieve since the spike is fixed to the opening and thus moves together with the moving inner portion of the diaphragm means. In conventional spike devices the spike extends out from and retracts into a circular channel. In such a design it is virtually impossible to prevent dirt, salt etc. from entering the channel.

A further advantage is that the spike is held steady when protruding from the sole, i.e. the risk that the spike should be bent and/or come loose during use of the shoe is low.

In an advantageous embodiment of the invention the elastic diaphragm means has a cup-shaped portion that is adapted to generate a spring force when subjected to an axial depression force, which spring force is capable of restoring the cup-shape when the depression force is removed. An advantage of using such a dome-shaped diaphragm means, compared to e.g. a flat piece of elastic material, is that the distance the spike moves when switching between its retracted and extended positions, i.e. the length of the spike stroke, can be made longer without exposing the diaphragm means to significant stress. An increased spike stroke length makes it easier to accomplish both a sufficient retraction and a sufficient extension of the spike. Further, reducing the stress leads to a more durable product. A dome-shaped diaphragm means has an additional advantage in that it efficiently removes dirt that may accumulate around the spike. Preferably, the inner portion forms a bottom part of the cup-shaped portion such that the spike protrudes from the bottom part in an axial direction inside the cup-shaped portion.

In an advantageous embodiment of the invention the spike device is adapted to be arranged in an opening of the sole.

In an advantageous embodiment of the invention the spike unit comprises a spike carrying member that is arranged to interact with an upper side of the diaphragm means such as to prevent the spike unit from moving further in a direction towards a lower side of the diaphragm means.

In an advantageous embodiment of the invention the guiding and supporting means comprises a spike guiding member having a through opening adapted to guide an axial movement of the spike unit.

In an advantageous embodiment of the invention the spike guiding member is rigidly connected to the outer portion of the diaphragm means.

In an advantageous embodiment of the invention the spike guiding member comprises a wing-shaped stopping means for securing the spike device inside the shoe.

In an advantageous embodiment of the invention the spike carrying member extends through the through opening and protrudes at an upper end of the through opening.

In an advantageous embodiment of the invention the diaphragm means forms part of a flexible member adapted to seal the sole opening.

In an advantageous embodiment of the invention the spike device is arranged such that the outer portion of the diaphragm means becomes substantially stationary in relation to the sole when the spike device is arranged in the shoe.

The invention also concerns a shoe having a spike device of the above type.

In an advantageous embodiment of the inventive shoe it comprises a lower sole member and an upper sole member, wherein the spike device is arranged in the lower sole member and wherein the lower sole member is vertically movable in relation to upper sole member such that the upper sole member is allowed to provide a pressure onto the spike device for forcing the spike to protrude from the sole.

In an advantageous embodiment of the inventive shoe it comprises an adjustable locking plate and spacing means adapted to allow prevention of the relative movement between the lower sole member and the upper sole member.

BRIEF DESCRIPTION OF THE DRAWINGS

In the description of the invention given below reference is made to the following figure, in which.

DETAILED DESCRIPTION OF VARIOUS EMBODIMENTS OF THE INVENTION

Figure 1:
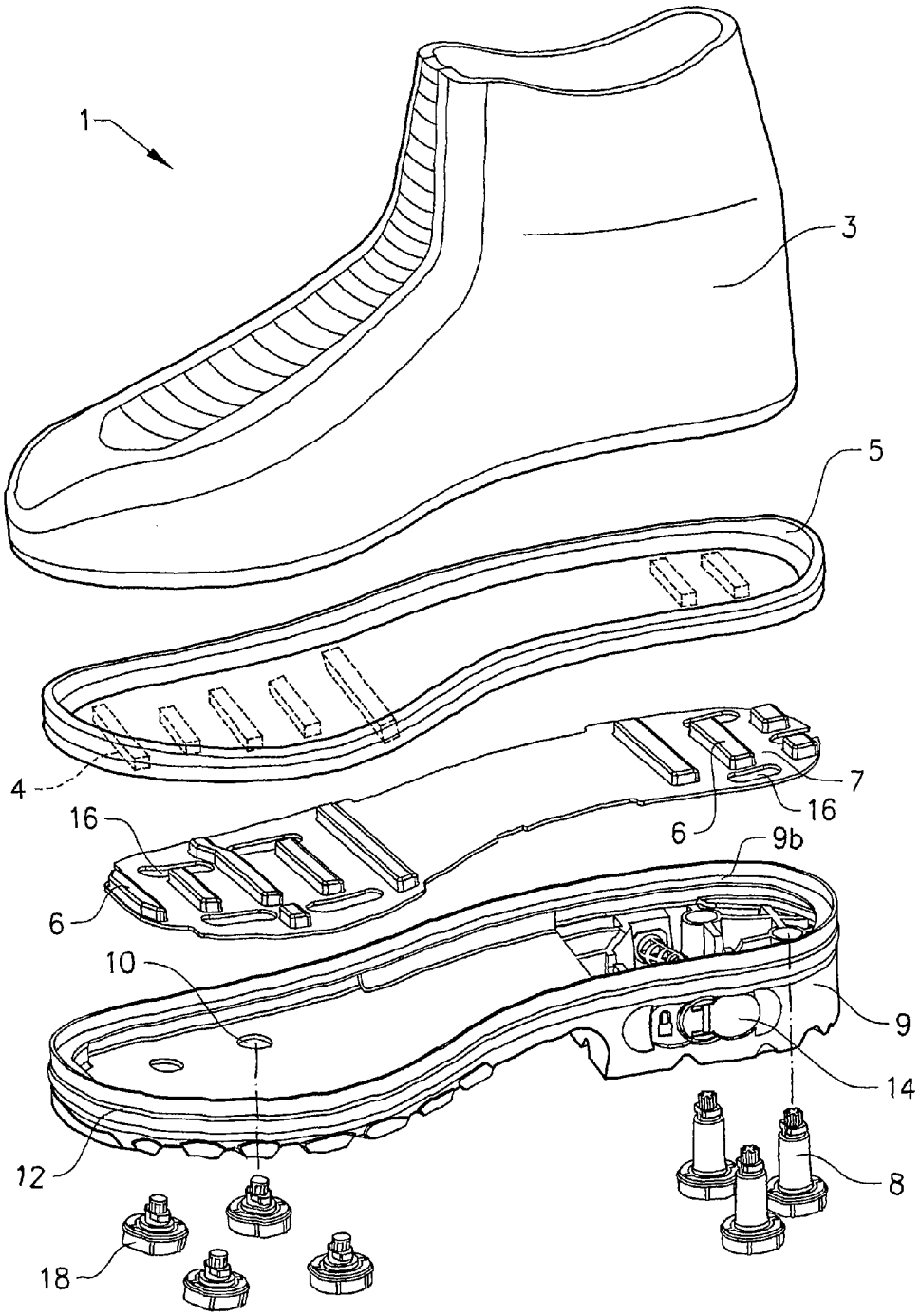
FIG. 1 shows, in an exploded view, a preferred embodiment of a shoe according to the invention.

FIG. 1 shows, in an exploded view, a preferred embodiment of an anti-slid shoe 1 according to the invention. The shoe 1 comprises an upper part 3, an upper sole member 5, a locking plate 7, a lower sole member 9 and a plurality of rear and front spike devices 8, 18. The lower sole member 9 is provided with a corresponding plurality of openings 10 for receiving the spike devices 8, 18. The spike devices 8, 18 are fastened to the lower sole member 9 when positioned in the corresponding openings 10.

The shoe 1 is arranged such as to allow variation of the distance between the upper and the lower sole members 5, 9 (except at some areas in the very front and in the arch part of the shoe where this variation is not important for the function of the spikes). A flexible sole connecting means 12 connects the upper and lower sole members 5, 9. The upper sole member 5 is, on its underside, provided with first spacing means 4 extending towards the locking plate 7. The locking plate 7 is, on its upper side, provided with corresponding second spacing means 6 extending towards the upper sole member 5 such as to allow interaction between the first and second spacing means 4, 6. The locking plate 7 is slidably adjustable in a longitudinal direction of the shoe 1 such that the first and second spacing means 4, 6 are movable relative each other. The first and second spacing means 4, 6 are in the form of integrated protrusions, in most cases having an elongated shape. The space between the protrusions of the first spacing means 4 may be regarded as openings for receiving the protrusions of the second spacing means 6 and vice versa.

When the locking plate 7 is positioned in a rear, locking position the shoe 1 is set in a locked, spike-retracted position with a certain first, fixed distance between the upper and lower sole members 5, 9. When the locking plate 7 is positioned in a forward, unlocking position the shoe 1 is set in an unlocked, anti-slid position where the distance between the upper and lower sole members 5, 9 can be varied such as to extend the spikes. This is further described below.

An actuator, comprising a handle 14 and a curved rod 15 (see FIGS. 10 and 11), for moving the locking plate 7 between its two positions is provided in a heel portion of the lower sole member 9.

Figure 2:
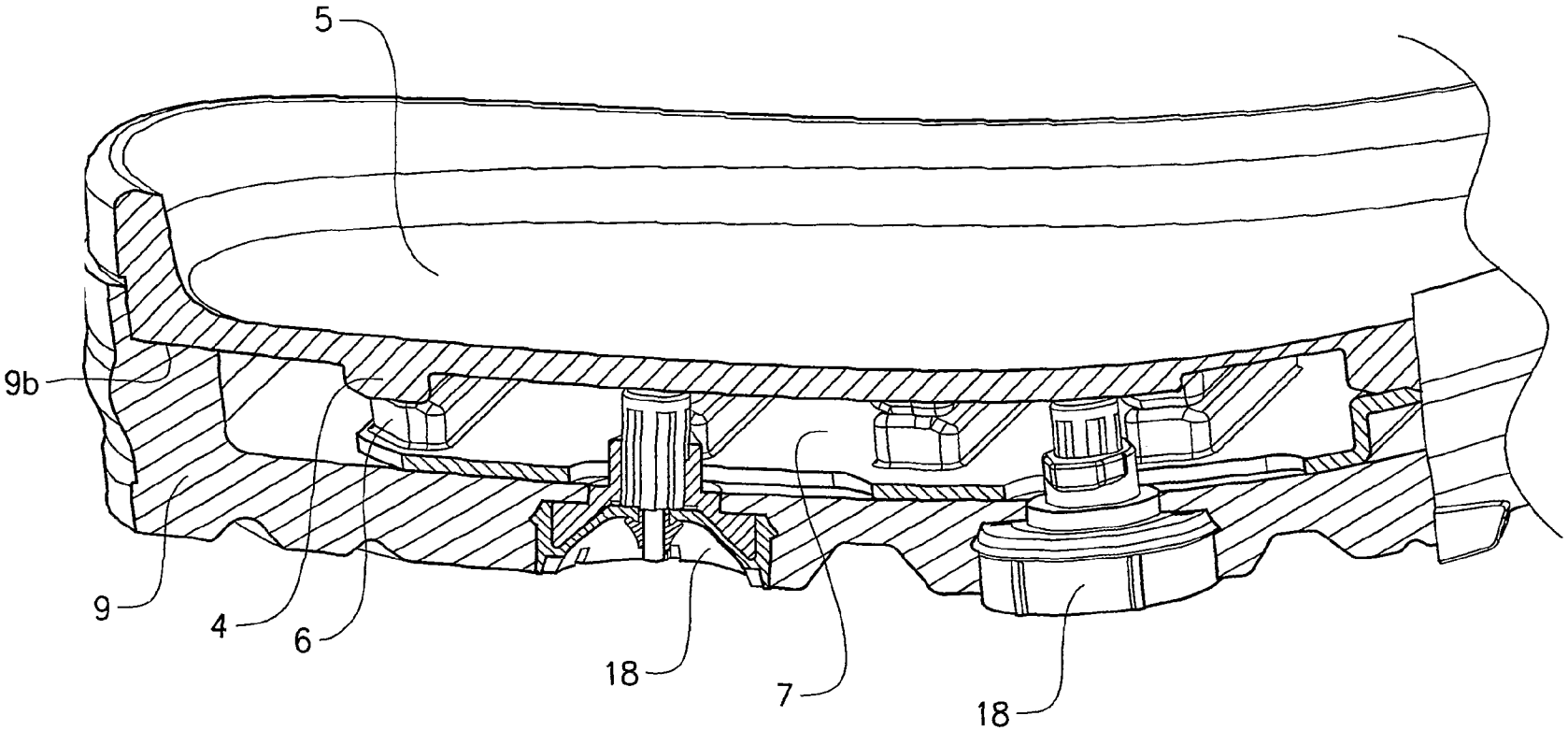
FIG. 2 shows, in a partly sectional view, a front portion of an assembled shoe according to FIG. 1.
Figure 3:
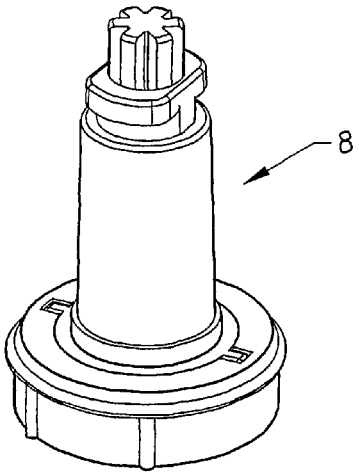
FIG. 3 shows a rear spike device of the shoe according to FIG. 1.
Figure 4:
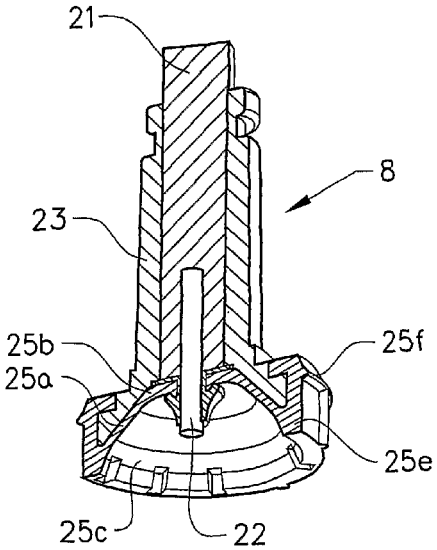
FIG. 4 shows, in a partly sectional view, the rear spike device according to FIG. 3.

FIG. 2 shows, in a partly sectional view, a front portion of the shoe 1 according to FIG. 1 in an assembled state. The locking plate 7 is here set in its rear, locking position such that the first spacing means 4 are aligned above the second spacing means 6. This way the upper and lower sole members 5, 9 are prevented from coming closer to each other than the distance defined by the sum of the heights of the first and second spacing means 4, 6.

The upper sole member 5 rests on a flexible flange 9*b* (see FIG. 1) arranged in the lower sole member 9. At the very front of the shoe 1, as well as in the arch part of the shoe 1, this flange is supported by underlying material. In areas close to this supporting material the distance between the upper and lower sole members 5, 9 can not be varied (except for compression of the supporting material). In the remaining areas, in particular in the areas where the spike devices 8, 18 are located, the distance can be varied because both the flange 9*b* and the upper sole member 5 are flexible. An advantage of supporting the flange 9*b* at some positions is that the shoe 1 becomes more steady when the locking plate 7 is set in its unlocking position.

FIG. 2 also shows two front spike devices 18 mounted to the lower sole member 9 in the openings 10. The spike devices 8, 18 extend vertically, in relation to a horizontally positioned shoe 1, through elongated openings 16 (see FIG. 1) and up to the underside of the upper sole member 5.

FIGS. 3-5 and 6-8 show a rear and front spike device 8, 18, respectively, of the shoe 1 according to FIG. 1. In principle, the front and rear spike devices 8, 18 have the same structure but the rear spike devices 8 are longer such as to fit in the thicker heel portion of the lower sole member 9.

Figure 5:
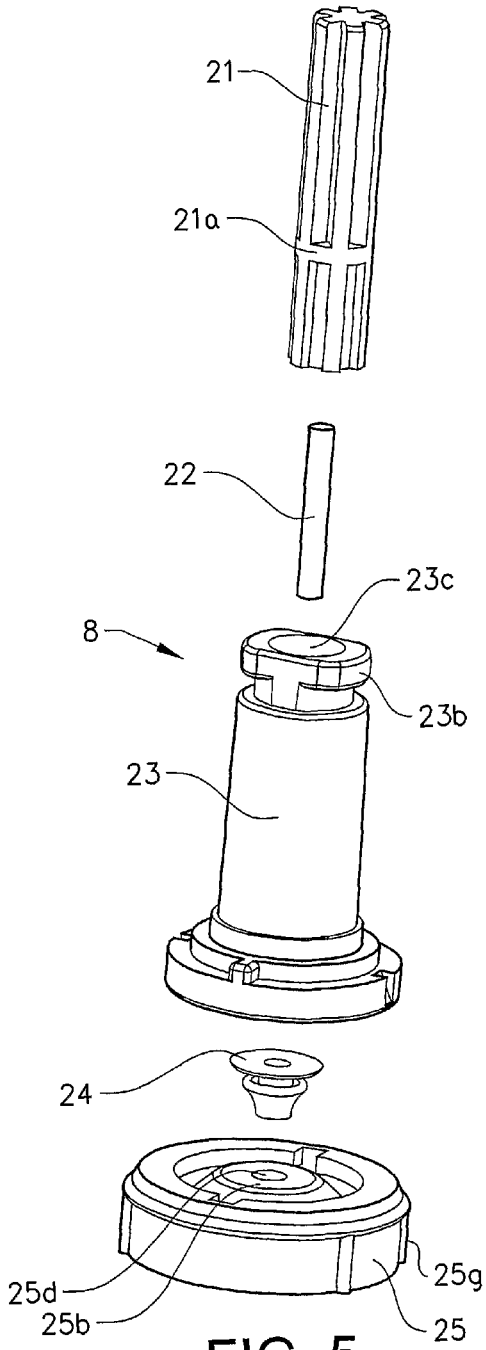
FIG. 5 shows, in an exploded view, the rear spike device according to FIG. 3.
Figure 6:
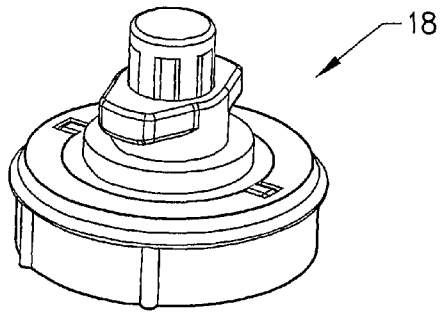
FIG. 6 shows a front spike device of the shoe according to FIG. 1.
Figure 7:
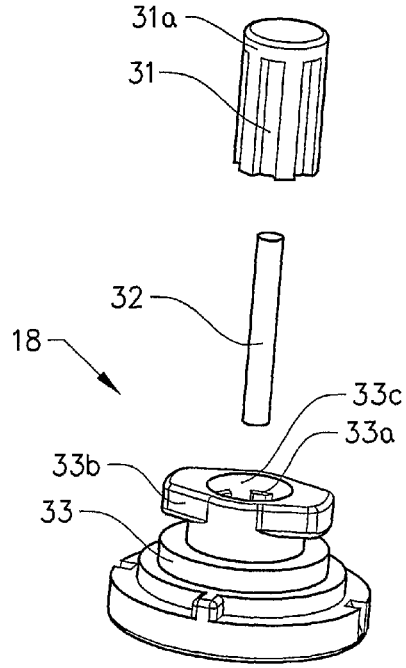
FIG. 7 shows, in a sectional side view, the front spike device according to FIG. 6.
Figure 7:
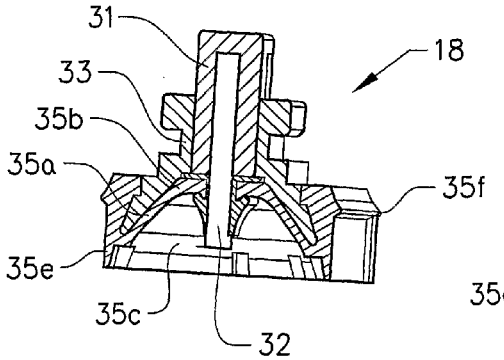
Figure 8:
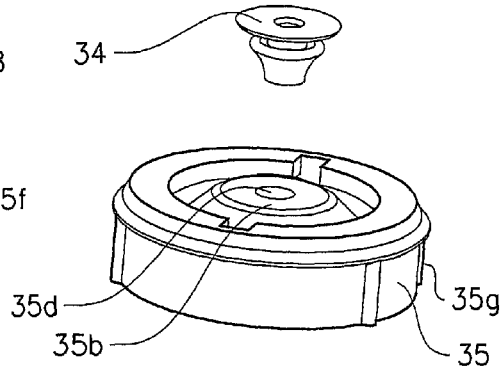
FIG. 8 shows, in an exploded view, the front spike device according to FIG. 6.

As clearly displayed in FIGS. 5 and 8 each spike device 8, 18 comprises a spike carrying member 21, 31, a spike 22, 32, a spike guiding member 23, 33, a press washer 24, 34 and a flexible member 25, 35.

The spike 22, 32 is preferably made of a hard metal or stainless steel to withstand wear. In this example the spikes 22, 32 have a diameter of 2 mm and a length of 15 mm. Other materials and dimensions are of course possible to use.

The spike carrying member 21, 31 is made of plastics and is moulded onto the spike 22, 32 as to form an integrated spike unit. The main function of the spike carrying member 21, 31 is to provide means for allowing control of the movement of the spike 22, 32 as further described below. A stopping means 21*a*, 31*a* in the form of a circumferentially extending protrusion is arranged at a certain distance from the lower end part of the spike carrying member 21, 31. The spike 22, 32 and the spike carrying member 21, 31 can alternatively be produced as one integral piece but such a component is likely to be more expensive to produce, at least if made of hard metal.

The spike guiding member 23, 33 is made of plastics and has a longitudinal through opening 23*c*, 33*c* adapted to receive the spike carrying member 21, 31 for fixing the spike unit 21, 31, 22, 32 in a radial direction. Main functions of the spike guiding member 23, 33 are i) to support, stabilize and guide the spike carrying member 21, 31, in particular when it moves axially inside the guiding member 23, 33 during use of the shoe 1; ii) to stabilize the flexible member 25, 35; and iii) to prevent the spike 22, 32 and the spike carrying member 21, 31 from moving too far downwards towards the flexible member 25, 35. The latter is achieved by providing each guiding member 23, 33 with internal stop cleats 33*a* (see FIG. 8) that are adapted to interact with the stopping means 21*a*, 31*a* on the carrying members 21, 31, and by providing the guiding member 23, 33 with a wing-shaped stopping means 23*b*, 33*b* arranged in a top portion of the guiding member 23, 33 and being adapted to be thread through the elongated openings 16 (see FIG. 1) in the locking plate 7 during installation of the spike devices 8, 18 such as to be capable of interacting with an upper side of the locking plate 5 when installed.

The spike carrying and guiding members 21, 31, 23, 33 can for instance be made of acetal or polyamide plastics and can be be reinforced with glass fibers.

The flexible member 25, 35 is in this example made of thermoplastic polyurethane and comprises a flexible diaphragm means in the form of a cup-shaped portion 25*a*, 35*a* having a bottom part 25*b*, 35*b* and an outer rim 25*e*, 35*e* surrounding a main opening 25*c*, 35*c* of the cup. The outer rim 25*e*, 35*e* extends upwards and somewhat inwards as to form an outer portion of the flexible member 25, 35 that surrounds the cup-shaped portion 25*a*, 35*a*. This outer portion is rigidly connected to the guiding member 23, 33.

A circular ridge or flange 25*f*, 35*f* extending around the outside of the outer portion of the flexible member 25, 35 is provided for fitting into a corresponding recess in the opening 10 of the lower sole member 9. This provides for a proper sealing when the spike device 8, 18 is attached to the opening 10 in the lower sole member 9. It also contributes in holding the flexible member 25, 35 in place. Vertically ridges 25*g*, 35*g* are also provided on the outside of outer portion of the flexible member 25, 35 for cooperation with corresponding recesses in the openings 10. This way unintentional rotation of the spike device 8, 18 is prevented.

An opening 25*b*, 35*b* is arranged in a central position of the bottom part 25*b*, 35*b* for receiving the press washer 24, 34 and the spike 22, 32.

The press washer 24, 34 is preferably made of aluminium or brass. It has a conical lower part that is forced through the opening 25*b*, 35*b* in the bottom part 25*b*, 35*b* as a first step when assembling the spike device 8, 18. The upper part of the press washer 24, 34 is slightly conical and is in this example pressed/riveted firmly to the bottom part 25*b*, 35*b* when fastened to the flexible member 25, 35. The press washer 24, 34 provides sealing around the spike 22, 32 and provides a support for the spike carrying member 21, 31.

After having fastened the press washer 24, 34, the spike guiding member 23, 33 is pressed/threaded in place onto the flexible member 25, 35 outside of the cup shaped portion 25*a*, 35*a* and inside of the outer portion extending from the outer rim 25*e*, 35*e* of the cup. Means for preventing relative rotation between the flexible member 25, 35 and the spike guiding member 23, 33 are provided in the form of stop cleats and corresponding recesses provided onto the two components.

In a next assembling step the integrated spike unit, comprising the spike 22, 32 and the spike carrying member 21, 31, is inserted into the guiding member 23, 33.

To install the spike device 8, 18 in the shoe 1 the spike device 8, 18 is inserted through the opening 10 in the lower sole member 9 and partly through the elongated openings 16 in the locking plate 7 and after that turned 90° such that the wing-shaped stopping means 23*b*, 33*b* become located above the locking plate 7 and such that all other cooperating fittings become properly attached. Each spike device 8, 18 is detachable from the shoe 1 which is an advantage since worn or malfunctioning spike devices 8, 18 can be exchanged.

When the spike device 8, 18 is mounted to the shoe 1, the spike 22, 32 and its spike carrying member 21, 31 as well as the cup-shaped portion 25*a*, 35*a* of the flexible member 25, 35 are movable in relation to the lower sole member 9. The other parts of the spike device 8, 18, for instance the outer rim 25*e*, 35*e* of the flexible member 25, 35, are stationary in relation to the lower sole member 9.

The flexible member 25, 35 has two main functions. The first function is to work as a spring that in a stressed state, i.e. in this example upon compression, allows the spike 22, 32 to protrude from the sole 9 and that when reverting to an unstressed state, i.e. in this example upon expansion, retracts the spike 22, 32 into the sole. The second function is to provide a sealing that prevents dirt, salt etc. from entering the shoe via the openings 10.

In principle, both these functions are achieved by the cup-shaped portion 25*a*, 35*a* of the flexible member 25, 35. Because it is cup-shaped, and because it is made in an elastic material, it has the capability of developing a spring force when subjected to axial depression, i.e. when depressed in a direction such that the bottom part 25*b*, 35*b* is moved towards the cup main opening 25*c*, 35*c* and thereby is brought closer to the outer rim 25*e*, 35*e* of the cup. The spring force generated is in turn capable of restoring the cup-shape when the depressing force is removed. This behaviour is similar to that of a suction cup or a cup spring.

The term "cup-shaped" means that the shape can be generally or partly dome-shaped or funnel-shaped, or could be some mixture of these two.

The spike 22, 32 is arranged to be stationary in relation to the bottom part 25*b*, 35*b* of the cup-shaped portion 25*a*, 35*a*, at least when the spike device 8, 18 is in use. An effect of this is that pressing the spike carrying member 21, 31 and thus the spike 22, 32 towards the cup-shaped portion 25*a*, 35*a* results in an axial depression of the cup-shaped portion 25*a*, 35*a* that deforms and generates a spring force as described above.

When the pressure is released the spring force restores the cup-shape and urges the spike 22, 32 back into its retracted position.

Figure 11:
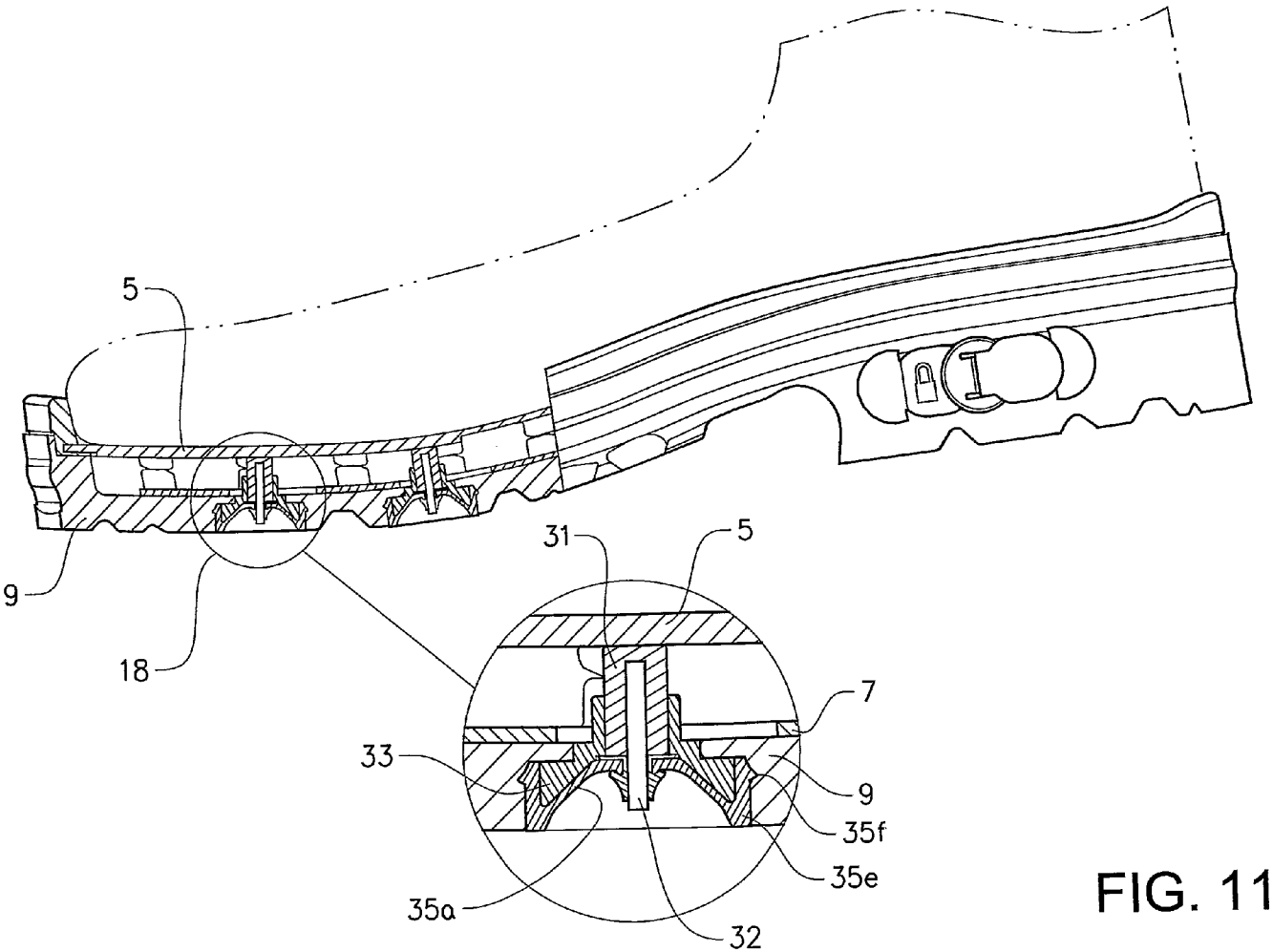
FIG. 11 shows a front spike device in a retracted position.
Figure 12:
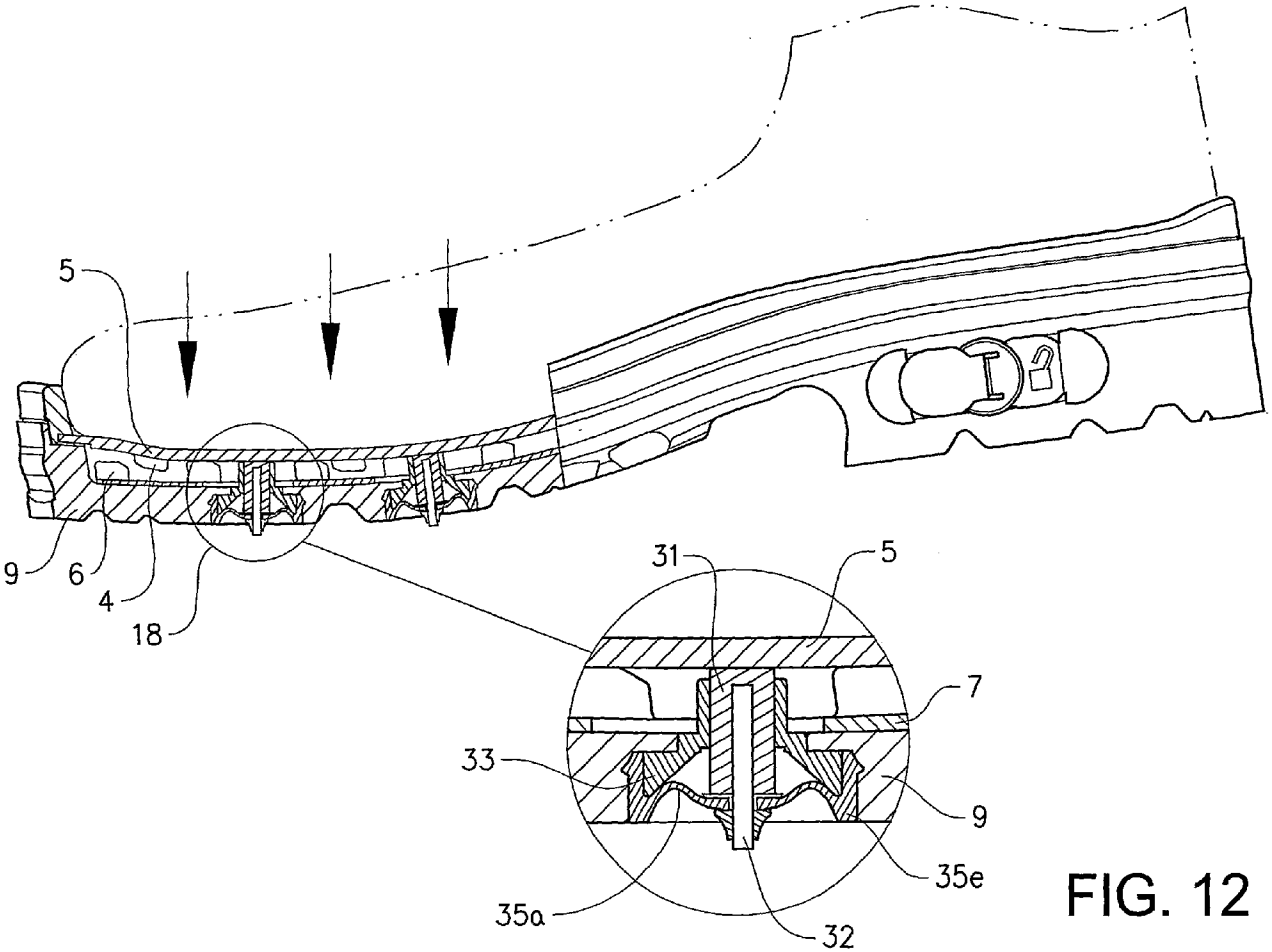
FIG. 12 shows a front spike device in an extended position.

In the embodiment shown here the shoe 1 is arranged to, when the locking plate 7 is set in its unlocking position, allow the upper sole member 5 to apply a pressure onto the upper side of the spike carrying member 21, 31 such as to press the spike 22, 32 downwards out from the lower sole member 9 while depressing the cup-shaped portion 25*a*, 35*a* axially. This is shown in FIG. 12. When no pressure is applied onto the upper side of the spike carrying member 21, 31 the cup-shape is reverted and the spike 22, 32 retracted. This is shown in FIG. 11.

The lower part of the press washer 24, 34 and the inside of the cup-shaped portion 25*a*, 35*a* of the flexible member are adapted to prevent pebbles and similar objects to get stuck and impair the function of the spike device 8, 18.

Figure 9:
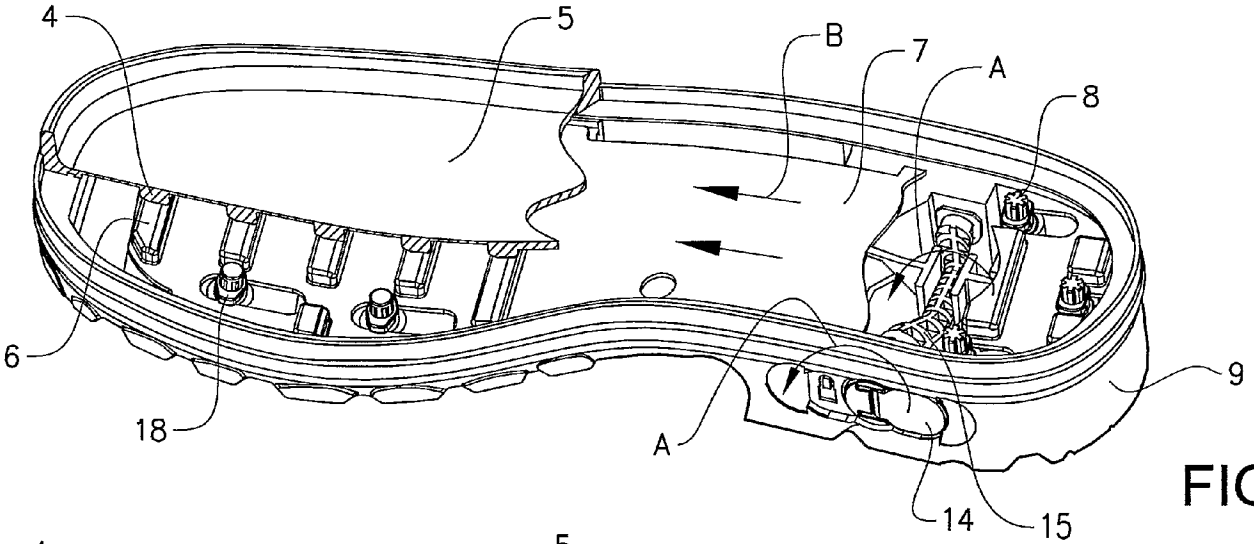
FIG. 9 shows the locking plate positioned in a rear, locking position in the shoe according to FIG. 1.

FIG. 9 shows the lower parts of an assembled shoe 1 where the locking plate 7 is positioned in a rear, locking position. In this position the upper and lower spacing means 4, 6 are aligned on top of each other such as to prevent relative vertical movement between the upper and lower sole members 5, 9. The spike devices 8, 18 are here positioned in the front part of the elongated openings 16. FIG. 9 is similar to what is shown in FIG. 2.

By extending the handle 14 and turn it anti-clockwise, as indicated by the arrows A, also the curved rod 15 will turn anti-clockwise which acts onto the locking plate 7 and forces it to slide in a forward direction, as indicated by the arrows B, such as to be positioned in a forward, unlocking position. This unlocking position is shown in FIG. 10.

Figure 10:
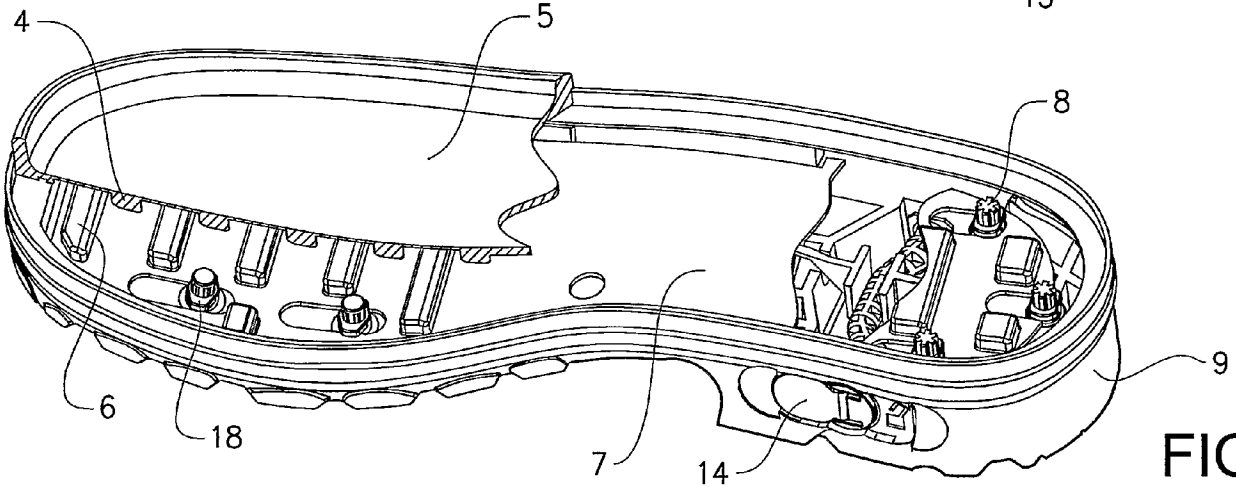
FIG. 10 shows the locking plate positioned in a forward, unlocking position in the shoe according to FIG. 1.

FIG. 10 shows further that in this position the spike devices 8, 18 are positioned in the front part of the elongated openings 16. It is also shown that the handle 14 has been folded back into the lower sole member 9.

In the position shown in FIG. 10 the upper and lower spacing means 4, 6 are displaced in relation to each other such as to allow the upper spacing means 4 to be positioned in the space between or at the side of the lower spacing means 6 and vice versa. Thus in this position relative vertical movement between the upper and lower sole members 5, 9 is allowed. By pressing the upper and lower sole members 5, 9 together, e.g. by taking a step with the shoe 1 and put weight on it, the underside of the upper sole member 5 will put a pressure onto the upper side of the spike carrying member 21, 31 such as to force the spike 22, 32 to protrude below the lower sole member 9. When the pressure onto the upper sole member 5 is released, for instance by taking a next step and lifting the foot from the ground, the resilient properties of the cup-shaped portion 25*a*, 35*a* of the flexible member 25 forces the spike 22, 32 to be retracted in the lower sole member 9.

This function is further displayed in FIGS. 11-12, wherein FIG. 11 shows a magnified view of a front spike device 18 in a retracted position, and wherein FIG. 12 shows a magnified view of a front spike device 18 in an extended position.

In FIG. 11 the shoe 1 is in its locked position with the spikes retracted in the lower sole member 9, i.e. the slidable locking plate 7 is set in its rear locking position. In the retracted position the spikes 32 are, in this particular example, positioned 2 mm above the lower surface of the lower sole member 9. The cup-shaped portion 35*b* of the flexible member 35 is now in a state of rest, i.e it is not subjected to axial (vertical) depression.

FIG. 11 also shows, among others, the flange or ridge 35*f* fitted into a recess in the opening 10 of the lower sole member 9, which flange 35*f* holds the flexible member 35, and in particular the outer rim 35*e*, in place.

In FIG. 12 the shoe 1 is in its unlocked position, i.e. the slidable locking plate 7 is set in its front unlocking position. A downwardly directed force indicated by the arrows, is applied to the upper sole member 5 in a region above the spike device 18. This has the effect that the upper sole member 5 moves towards the lower sole member 9 while pressing the spike carrying member 31 downwards through the spike guiding member 33. This way the cup-shaped portion 35*a* becomes decompressed in an axial (vertical) direction which in turn has the effect that the spike 32 extends below, in this case 3 mm below, the lower sole member 9. As can be seen in FIG. 12 it is mainly an intermediate part of the cup-shaped portion 35*a*, i.e. the part connecting the bottom part 35*b* and the outer rim 35*e*, that deforms and creates the spring force that automatically forces the spike 32 back to its retracted position when the pressure is released.

The spike device 8, 18 is intended to be arranged in the sole 9 such that the periphery portion 25*e*, 35*e* of the diaphragm means 25*a*, 35*a* is stationary in relation to the sole 9.

The spike device 8, 18 forms a separate unit adapted to be attached to the shoe 1.

The cup-shaped elastic diaphragm means 25*a*, 35*a* has a lower side intended to be facing downwards, away from the shoe 1, and an upper side intended to be facing upwards, towards the shoe 1, when the spike device 8, 18 is arranged in the shoe 1. The guiding and supporting means 23, 33 for guiding the axial movement of the spike unit 21, 31, 22, 32 is arranged on the upper side of the diaphragm means 25*a*, 35*a*.

The invention is not limited by the embodiments described above but can be modified in various ways within the scope of the claims.

For instance, the diaphragm means 25*a*, 35*a* need not to be cup-shaped but can be e.g. a flat piece of elastic material that allows the spike 22, 32 to move in relation to an outer rim and that reverts to the flat form when no pressure is applied onto the spike 22, 32. An advantage of using a dome-shaped diaphragm means 25*a*, 35*a* is, however, that the distance the spike moves when switching between its retracted and extended positions, i.e. the length of the spike stroke, can be made longer without exposing the diaphragm means 25*a*, 35*a* to significant stress. An increased spike stroke length makes it easier to accomplish both a sufficient retraction and a sufficient extension of the spike. Further, reducing the stress leads to a more durable product.

The lead-through of the spike unit 21, 31, 22, 32 through the diaphragm means 25*a*, 35*a* can be arranged in different ways. For instance, the press washer 24, 34 can be pressed in place from the underside of the diaphragm means 25*a*, 35*a* by providing the spike with a recess and by providing the washer with a corresponding flange/protrusion that is pressed and snapped in place. Further, the diaphragm means 25*a*, 35*a* can be provided with a flange surrounding the opening 25*d*, 35*d*. Preferably, both the washer and the spike carrying member 21, 31 are arranged to surround this flange. This gives a good support to and guiding of the spike unit 21, 31, 22, 32.

Moreover, the spike 22, 32 can be provided with a head that prevents the spike 22, 32 from come loose from the spike carrying member 21, 31.

The invention claimed is:

1. A spike device for a sole of an anti-slid shoe, said spike device comprising:

a spike and a resilient member, said resilient member being arranged to, when in a stressed state, allow the spike to protrude from the sole of the anti-slid shoe for providing anti-slid properties and to, when reverting to an unstressed state, retract the spike at least partly into the sole;

wherein the resilient member comprises an elastic diaphragm having an inner portion and an outer portion surrounding the inner portion, wherein the inner and outer portions are resiliently movable in relation to each other;

wherein a spike unit comprising the spike is arranged through an opening in the inner portion of the elastic diaphragm in such a way that the spike protrudes in an axial direction from the elastic diaphragm;

wherein the spike unit is arranged to be moveable in an axial direction and to be fixed in relation to the opening in the inner portion of the elastic diaphragm so as to allow the spike unit to move together with the inner portion of the elastic diaphragm; and wherein said spike device further comprises a guiding and supporting member for guiding the axial movement of the spike unit when the inner portion moves in relation to the outer portion.

2. The spike device according to claim 1, wherein:

the elastic diaphragm comprises a cup-shaped portion that is adapted to generate a spring force when subjected to an axial depression force; and the spring force is capable of restoring the cup-shaped portion when the depression force is removed.

3. The spike device according to claim 2, wherein the inner portion forms a bottom part of the cup-shaped portion such that the spike protrudes from the bottom part in an axial direction inside the cup-shaped portion.

4. The spike device according to claim 1, wherein the spike device is adapted to be arranged in an opening of the sole.

5. The spike device according to claim 1, wherein the spike unit comprises a spike carrying member that is arranged to interact with an upper side of the elastic diaphragm such as to prevent the spike unit from moving further in a direction towards a lower side of the elastic diaphragm.

6. The spike device according to claim 5, wherein the spike carrying member extends through the through opening and protrudes at an upper end of the through opening.

7. The spike device according to claim 1, wherein the guiding and supporting member comprises a spike guiding member having a through opening adapted to guide an axial movement of the spike unit.

8. The spike device according to claim 7, wherein the spike guiding member is rigidly connected to the outer portion of the elastic diaphragm.

9. The spike device according to claim 7, wherein the spike guiding member comprises a wing-shaped stopping member for securing the spike device inside the shoe.

10. The spike device according to claim 7, wherein the spike carrying member extends through the through opening and protrudes at an upper end of the through opening.

11. The spike device according to claim 4, wherein the elastic diaphragm forms part of a flexible member adapted to seal the sole opening.

12. The spike device according to claim 1, wherein the spike device is arranged such that the outer portion of the elastic diaphragm becomes substantially stationary in relation to the sole when the spike device is arranged in the shoe.

13. A shoe comprising the spike device according to claim 1.

14. The shoe according to claim 13, wherein:

the shoe further comprises a lower sole member and an upper sole member;

the spike device is arranged in the lower sole member; and the lower sole member is vertically movable in relation to upper sole member such that the upper sole member is allowed to provide a pressure onto the spike device for forcing the spike to protrude from the lower sole member.

15. The shoe according to claim 14, wherein the shoe further comprises an adjustable locking plate and a spacing member configured to allow prevention of the relative movement between the lower sole member and the upper sole member.

* * * * *